US011480032B2

(12) United States Patent
Garcia

(10) Patent No.: US 11,480,032 B2
(45) Date of Patent: Oct. 25, 2022

(54) DEBRIS COLLECTION TOOL

(71) Applicant: Weatherford Technology Holdings, LLC, Houston, TX (US)

(72) Inventor: Matthew Daniel Garcia, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/805,941

(22) Filed: Mar. 2, 2020

(65) Prior Publication Data

US 2021/0270108 A1 Sep. 2, 2021

(51) Int. Cl.

| | |
|---|---|
| ***E21B 31/00*** | (2006.01) |
| ***E21B 31/06*** | (2006.01) |
| ***E21B 37/00*** | (2006.01) |
| *H01F 7/02* | (2006.01) |

(52) U.S. Cl.

CPC ..... *E21B 37/00* (2013.01); *H01F 7/0221* (2013.01)

(58) Field of Classification Search

CPC ..... E21B 37/00; E21B 31/06; E21B 31/00; E21B 27/00; E21B 37/02; E21B 27/005; E21B 47/092; E21B 41/00; E21B 21/00; E21B 41/0085; E21B 31/03; E21B 33/08; E21B 36/00; H01F 7/0221; H01F 7/02

See application file for complete search history.

(56) References Cited

U.S. PATENT DOCUMENTS 2,778,669 A * 1/1957 Goodwin ..... E21B 31/06 81/125
4,031,750 A * 6/1977 Youmans ..... E21B 23/14 340/856.1
4,059,155 A * 11/1977 Greer ..... E21B 27/00 166/99
4,109,521 A * 8/1978 Youmans ..... E21B 23/14 73/152.56
4,549,341 A * 10/1985 Kasabian ..... H02K 1/278 310/156.19
5,207,272 A * 5/1993 Pringle ..... E21B 43/123 166/120

(Continued)

FOREIGN PATENT DOCUMENTS

EP 2868862 A1 5/2015
GB 2350632 A 12/2000

(Continued)

OTHER PUBLICATIONS

International Search Report and Written Opinion dated Apr. 16, 2021 for Application No. PCT/US2021/018122.

*Primary Examiner* — Edwin J Toledo-Duran
(74) *Attorney, Agent, or Firm* — Patterson + Sheridan, LLP

(57) ABSTRACT

A method and apparatus for operating a debris removal tool. In one embodiment, the tool includes a cover assembly having a plurality of covers spaced from one another along the length of the assembly creating a gap between adjacent covers. A carrier disposed within the cover assembly is axial movable relative thereto and has a plurality of magnet groups spaced from one another along its length. In an unactuated position of the tool, each of the plurality of magnet groups is under one of the plurality of covers and in an actuated position, each of the plurality of magnets is in a gap between covers.

20 Claims, 19 Drawing Sheets

(56) References Cited

U.S. PATENT DOCUMENTS 6,114,851 A * 9/2000 Kruspe ..... G01V 3/32 324/303
6,216,787 B1 * 4/2001 Ruttley ..... E21B 31/06 175/328
6,439,303 B1 * 8/2002 Sorhus ..... E21B 31/06 166/99
6,491,117 B2 * 12/2002 Ruttley ..... E21B 41/00 175/328
6,655,462 B1 * 12/2003 Carmichael ..... B08B 9/0553 166/99
7,137,449 B2 * 11/2006 Silguero ..... E21B 31/06 166/99
7,219,724 B2 * 5/2007 Theriot, Sr. ..... E21B 37/00 166/99
7,330,397 B2 * 2/2008 Ganesan ..... E21B 47/18 340/854.6
7,353,873 B2 * 4/2008 Borst ..... E21B 37/00 210/695
7,735,547 B2 * 6/2010 Telfer ..... E21B 37/00 166/173
7,753,114 B1 * 7/2010 Penisson ..... E21B 37/00 166/99
7,753,124 B1 * 7/2010 Penisson ..... E21B 27/00 166/66.5
8,220,532 B2 * 7/2012 Hagen ..... E21B 37/00 166/99
8,353,349 B2 * 1/2013 Hern ..... E21B 37/00 175/328
8,678,091 B2 * 3/2014 Nelson ..... E21B 37/00 166/311
8,800,660 B2 * 8/2014 Fishbeck ..... E21B 31/06 166/99
8,844,622 B2 * 9/2014 Telfer ..... E21B 37/04 166/173
9,260,941 B2 * 2/2016 Linklater ..... E21B 37/00
9,822,610 B2 * 11/2017 Delzell ..... E21B 34/06
9,863,217 B2 1/2018 Cooper
9,863,219 B2 * 1/2018 Leiper ..... E21B 37/00
10,077,634 B2 * 9/2018 Perio, Jr. ..... E21B 31/06
10,208,553 B2 * 2/2019 Sullivan ..... E21B 31/06
10,240,417 B2 * 3/2019 Stangeland ..... E21B 37/02
10,487,627 B2 11/2019 Leiper et al.
10,895,129 B2 * 1/2021 Linklater ..... E21B 27/00
2004/0163809 A1 * 8/2004 Mayeu ..... G01B 11/002 166/334.1
2005/0028982 A1 * 2/2005 Howlett ..... E21B 10/325 166/55.7
2005/0205251 A1 * 9/2005 Tulloch ..... E21B 37/02 166/173
2005/0274524 A1 * 12/2005 Silguero ..... E21B 31/06 166/66.5
2006/0011346 A1 * 1/2006 Theriot, Sr. ..... E21B 21/065 166/99
2006/0175064 A1 * 8/2006 Yuratich ..... F16C 33/10 166/381
2007/0096571 A1 * 5/2007 Yuratich ..... H02K 9/00 310/90
2007/0107894 A1 * 5/2007 Ruttley ..... E21B 21/065 166/99
2008/0196881 A1 * 8/2008 Telfer ..... E21B 37/00 166/70
2008/0202756 A1 * 8/2008 Borst ..... E21B 37/00 166/177.3
2008/0236819 A1 * 10/2008 Foster ..... E21B 47/092 166/255.2
2009/0211816 A1 * 8/2009 Williams ..... E21B 37/00 175/328
2010/0109906 A1 * 5/2010 Montgomery ..... E21B 34/14 340/853.2
2010/0181064 A1 * 7/2010 Knobloch ..... E21B 17/1057 166/99
2011/0284203 A1 * 11/2011 Hern ..... E21B 37/00 166/66.5
2011/0284210 A1 * 11/2011 Hern ..... E21B 37/00 166/99
2011/0284211 A1 * 11/2011 Hern ..... E21B 37/00 166/99
2012/0126809 A1 * 5/2012 Hopper ..... G01R 33/3808 324/318
2013/0000884 A1 * 1/2013 Linklater ..... E21B 37/00 166/66.5
2013/0020104 A1 * 1/2013 Takahashi ..... H02K 41/0356 173/148
2014/0096972 A1 * 4/2014 Leiper ..... E21B 37/00 166/66.5
2015/0122480 A1 * 5/2015 Sullivan ..... E21B 31/06 166/66.5
2015/0192000 A1 * 7/2015 Cooper ..... E21B 31/06 166/243
2016/0032688 A1 * 2/2016 Donderici ..... E21B 47/11 166/381
2016/0040506 A1 * 2/2016 Goodman ..... G01V 3/28 166/243
2016/0047228 A1 * 2/2016 Frosell ..... G01V 3/081 324/326
2016/0208579 A1 * 7/2016 Delzell ..... E21B 47/092
2016/0208580 A1 * 7/2016 Delzell ..... E21B 41/00
2016/0268041 A1 * 9/2016 Deville ..... H01F 38/14
2017/0051576 A1 * 2/2017 Perio, Jr. ..... E21B 31/06
2019/0136668 A1 * 5/2019 McMillon ..... E21B 23/00
2021/0115746 A1 * 4/2021 Atkins ..... E21B 21/002
2021/0285301 A1 * 9/2021 Maher ..... E21B 37/00

FOREIGN PATENT DOCUMENTS

WO 2006120453 A1 11/2006
WO 2017065721 A1 4/2017

* cited by examiner

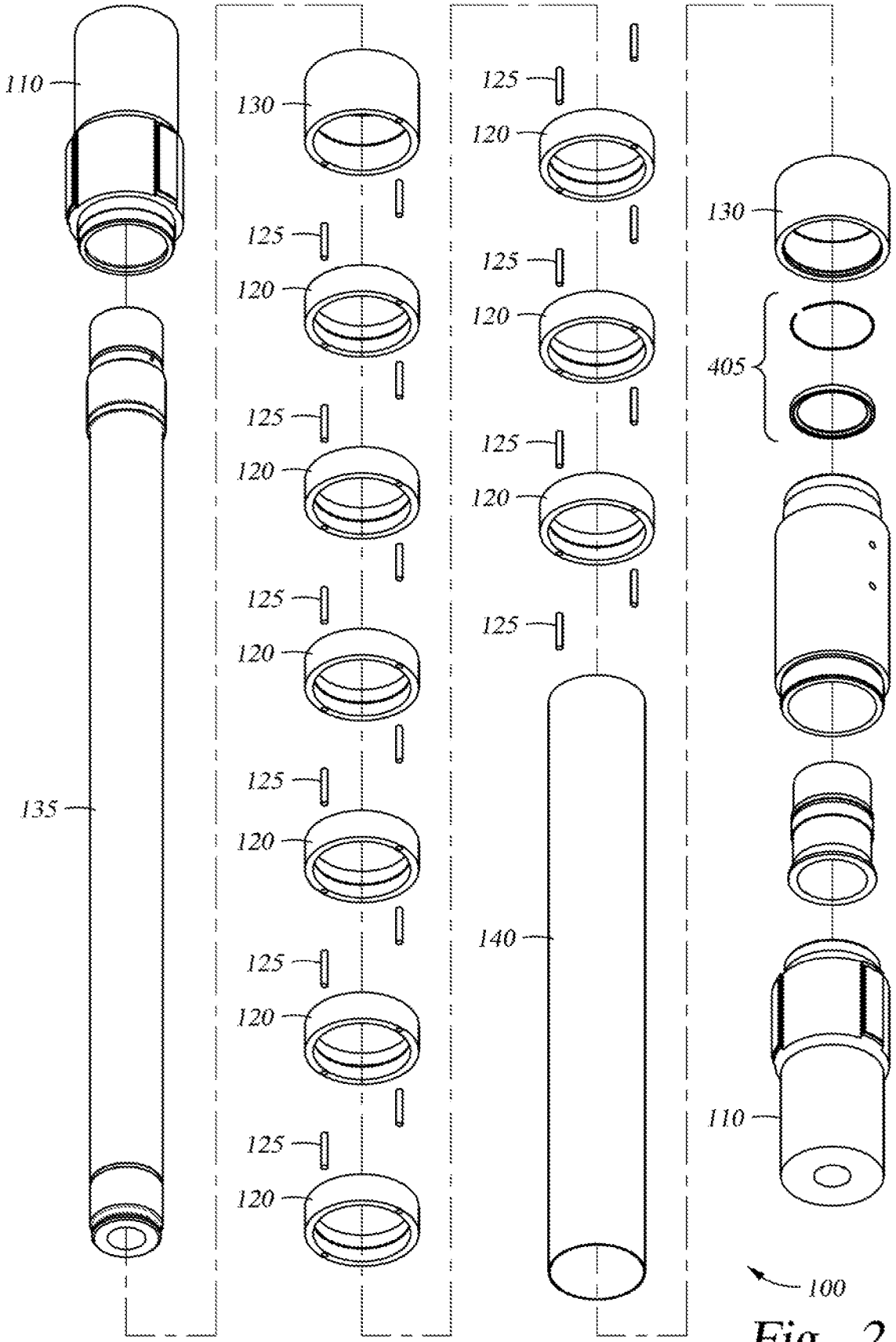
110
130
125
120
125
120
125
120

DEBRIS COLLECTION TOOL

BACKGROUND OF THE INVENTION

Field of the Invention

The present invention relates to wellbore tools. More specifically, the invention relates to a debris collection tool utilizing magnets to collect metallic debris in a wellbore.

Description of the Related Art

Many operations in an oil or gas well often produce a variety of debris in the wellbore. For example, milling operations may produce metallic mill cuttings, which may not be completely removed by simple circulation of fluid in the wellbore. Retrieval tools containing magnets have been used to collect the debris in wellbores. Magnetic retrieval tools typically have magnets disposed on the exterior of the tool. Having the magnets continuously attracting metallic objects is problematic as there are times when the tool needs to be non-attractive to debris, like during run-in. Some tools have electro magnets that can be turned on and off remotely from the surface. These are unreliable and often require a source of power downhole. In any case, having magnets exposed even when not in use increases the chance of damage and malfunction.

There is a need, therefore, for an improved magnetic retrieval tool for retrieving debris from the wellbore.

SUMMARY OF THE INVENTION

The present invention generally relates to a debris removal tool for use in a wellbore. In one embodiment, the tool includes a cover assembly having a plurality of covers spaced from one another along the length of the assembly creating a gap between adjacent covers. A carrier disposed within the cover assembly is axial movable relative thereto and has a plurality of magnet groups spaced from one another along its length. In an unactuated position of the tool, each of the plurality of magnet groups is under one of the plurality of covers and in an actuated position, each of the plurality of magnets is in a gap between covers. In another embodiment, a method of operating the tool includes running the tool into the wellbore on a string of tubulars to a predetermined depth and thereafter, providing fluid pressure to a piston surface formed on the carrier thereby causing the tool to move from a deactivated position wherein the magnets are covered, to an activated position wherein the magnets are exposed to the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 2 is an exploded view of the cover assembly.

DETAILED DESCRIPTION

Figure 1:
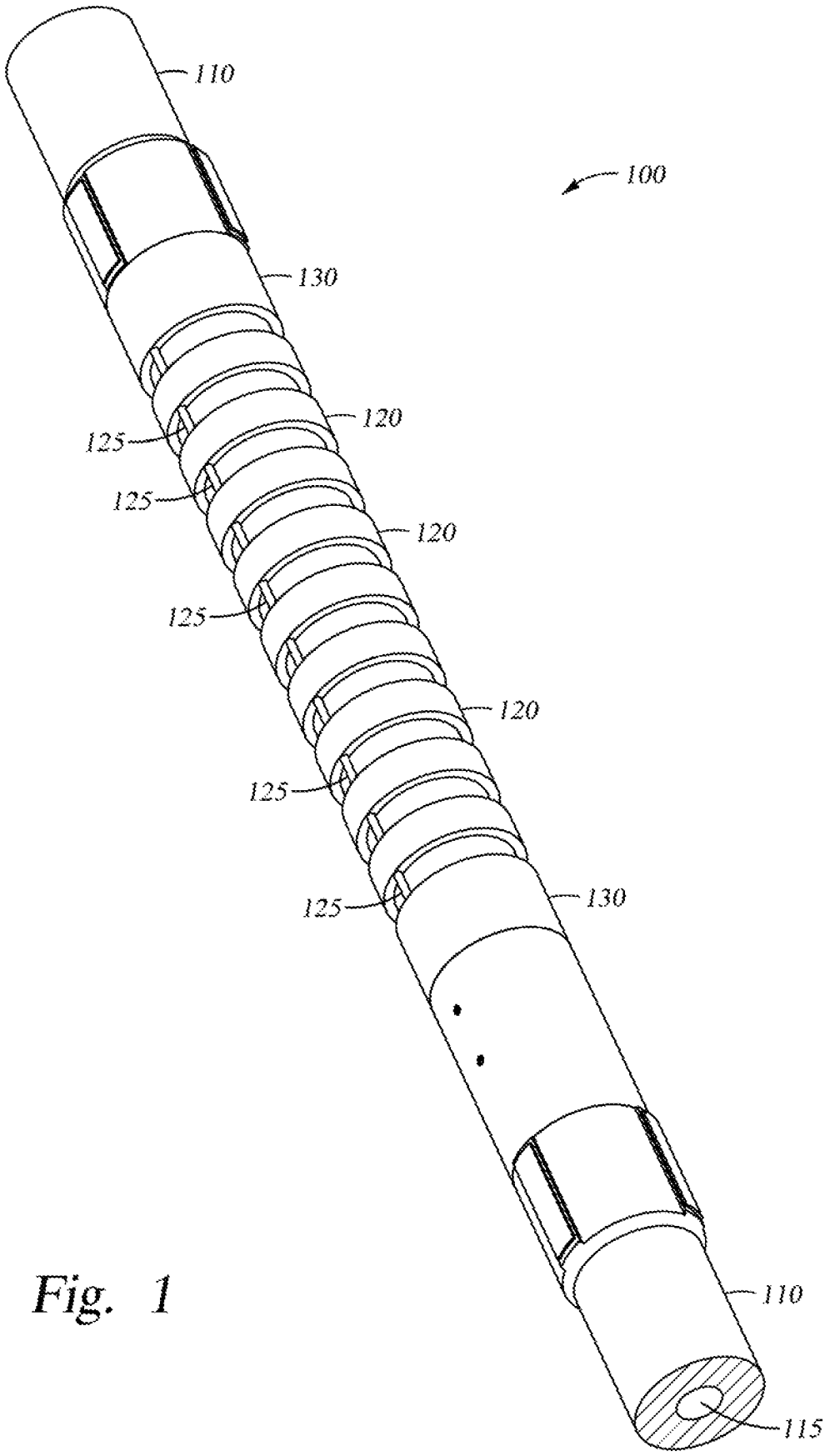
FIG. 1 is a perspective view of a cover assembly.

The debris removal tool 500 of the present invention is primarily made up of two assemblies: a cover assembly and a magnet assembly. FIG. 1 is a perspective view of the cover assembly 100. The assembly is constructed and arranged to cover a magnet assembly 300 (FIG. 3A, B) that moves axially within the cover assembly to expose or cover a plurality of magnet groups 310. The cover assembly 100 includes an upper and lower end caps 110 and includes a bore 115 extending the length of the assembly. The assembly also includes a plurality of spaced covers 120 each of which is separated from an adjacent cover by spacer pins 125. Upper and lower end covers 130 are wider than the other covers. FIG. 2 is an exploded view of the cover assembly 100 of FIG. 1. Visible in the exploded view are the end caps 110, covers 120, and spacer pins 125 introduced in FIG. 1. Additionally visible are an inner tube 135, a particle shield 140, and a ring assembly 405.

Figure 3A:
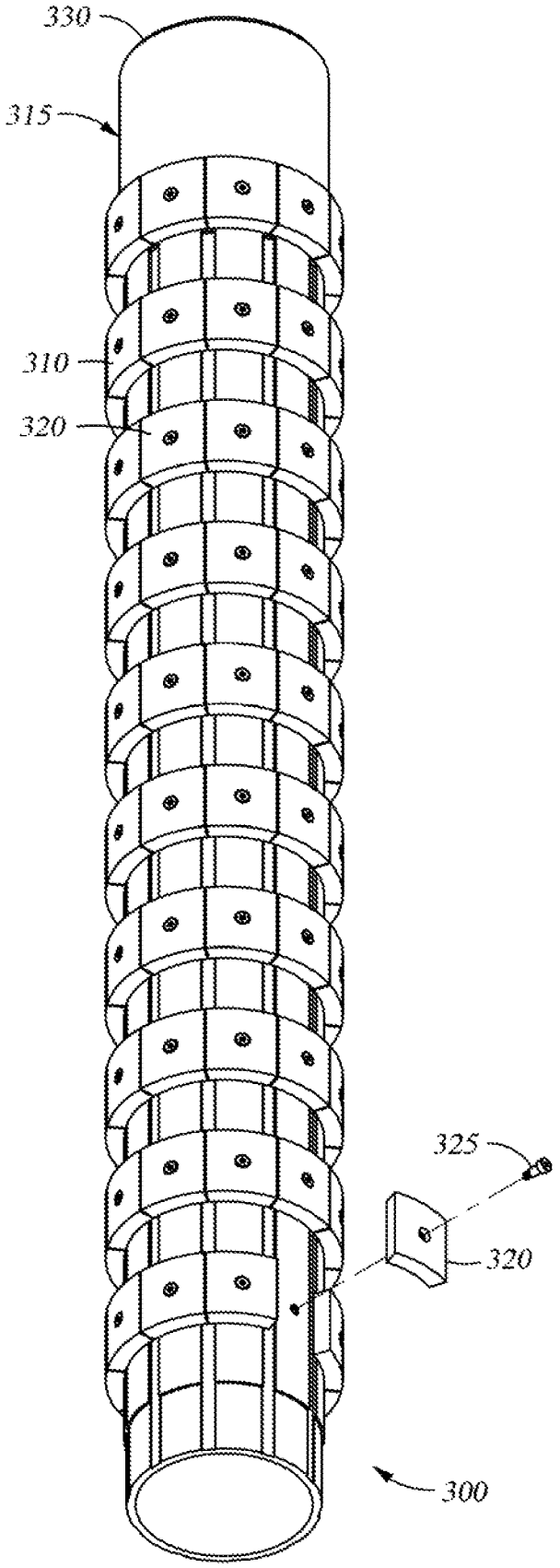
FIGS. 3A and 3B are perspective views of a magnet assembly.
Figure 3B:
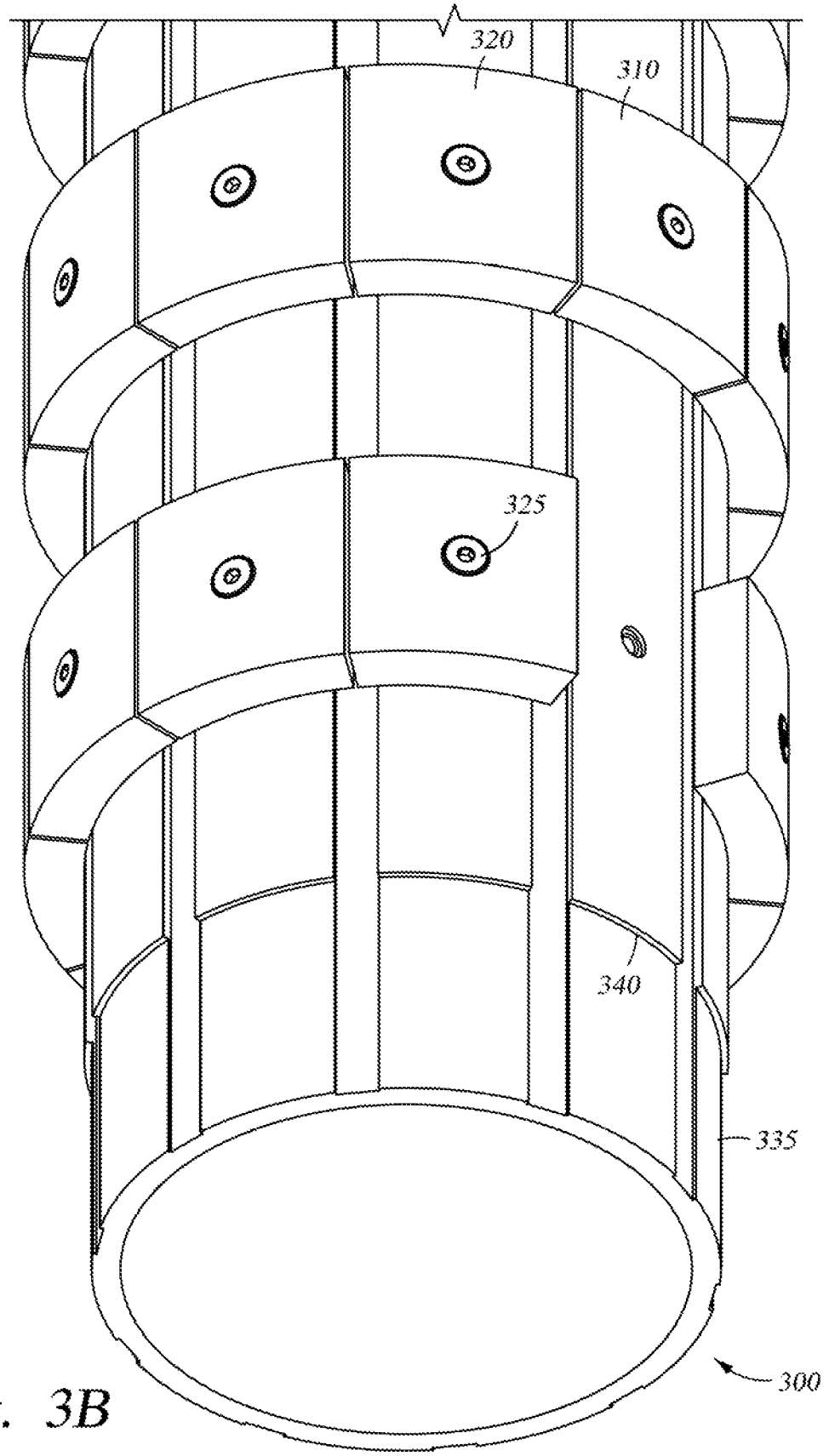

FIGS. 3A and 3B are perspective views of the magnet assembly 300. The magnet assembly, in the embodiment shown is installed inside and axially movable within the cover assembly 100 in a manner whereby magnet groups 310 are covered when the tool is in a deactivated position but exposed in an activated position. The assembly 300 includes a carrier 315 having a bore therethrough. Each magnet group consists of magnets disposed radially around the body of the carrier. Each individual magnet 320 is attached to the carrier by a fastener 325. In addition to housing the magnets, the carrier has a piston surface 330 at an upper end and acts as an annular piston to shift the magnet assembly 300 between the two positions of the tool. FIG. 3B is an enlarged view of a lower end of the carrier 315. As shown, the carrier has a reduced diameter portion 335 at a lower end with a shoulder 340 formed at a transition point between the two outer diameters. The reduced diameter portion and shoulder are integral to shifting the tool as will be explained herein.

Figure 4:
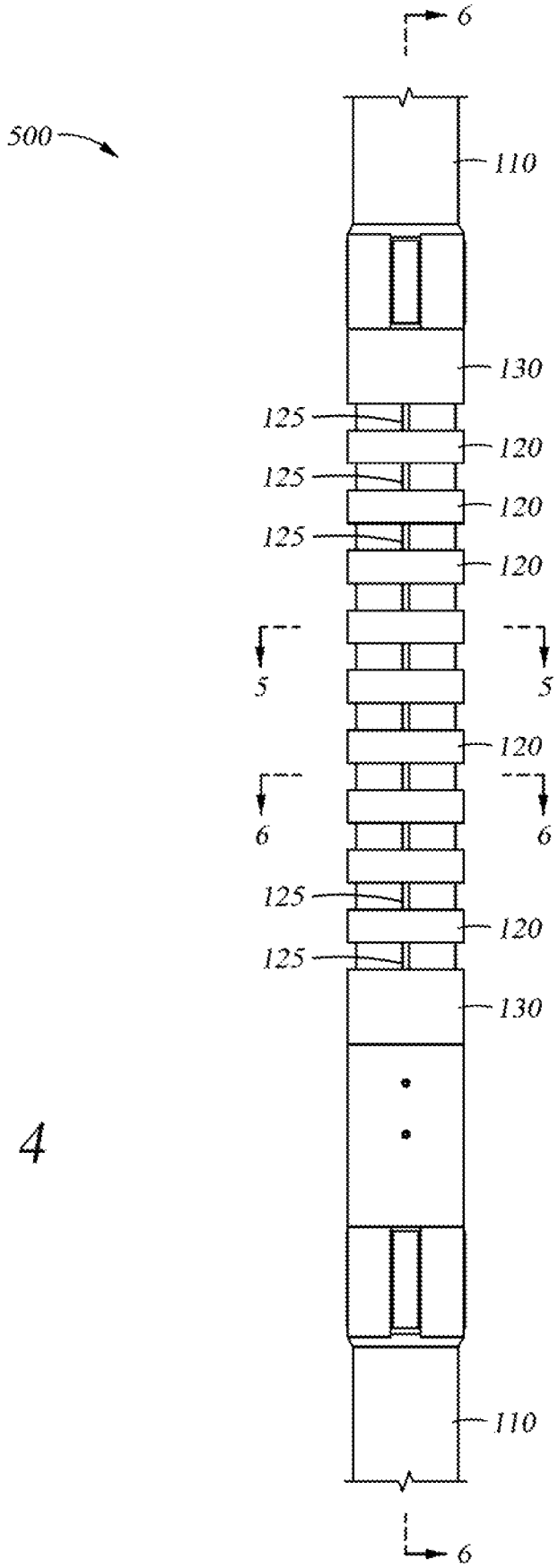
FIG. 4 is a front view of the assembled tool.
Figure 5:
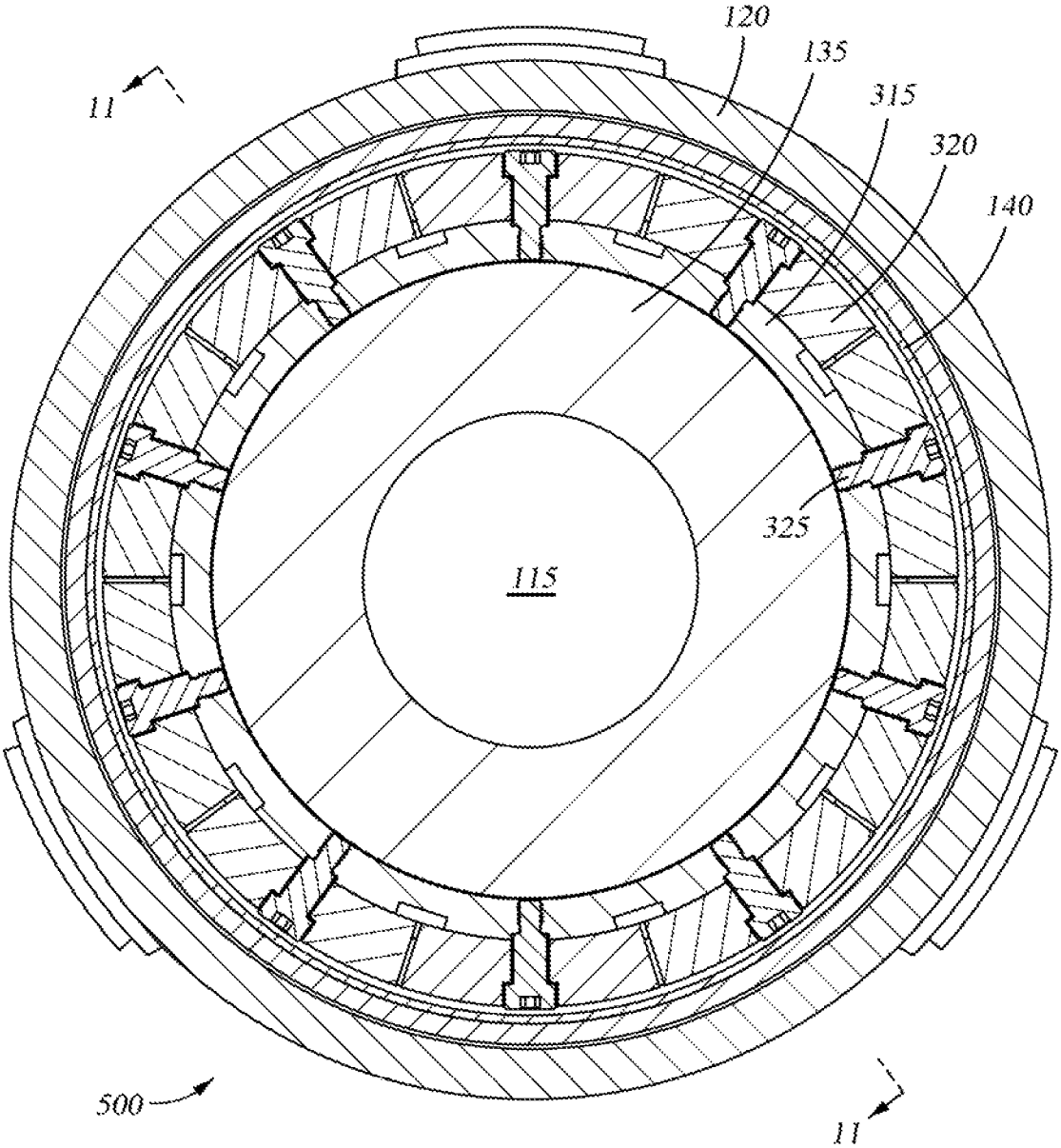
FIGS. 5 and 6 are section views of the deactivated tool taken along lines 5-5 and 6-6 of FIG. 4.
Figure 6:
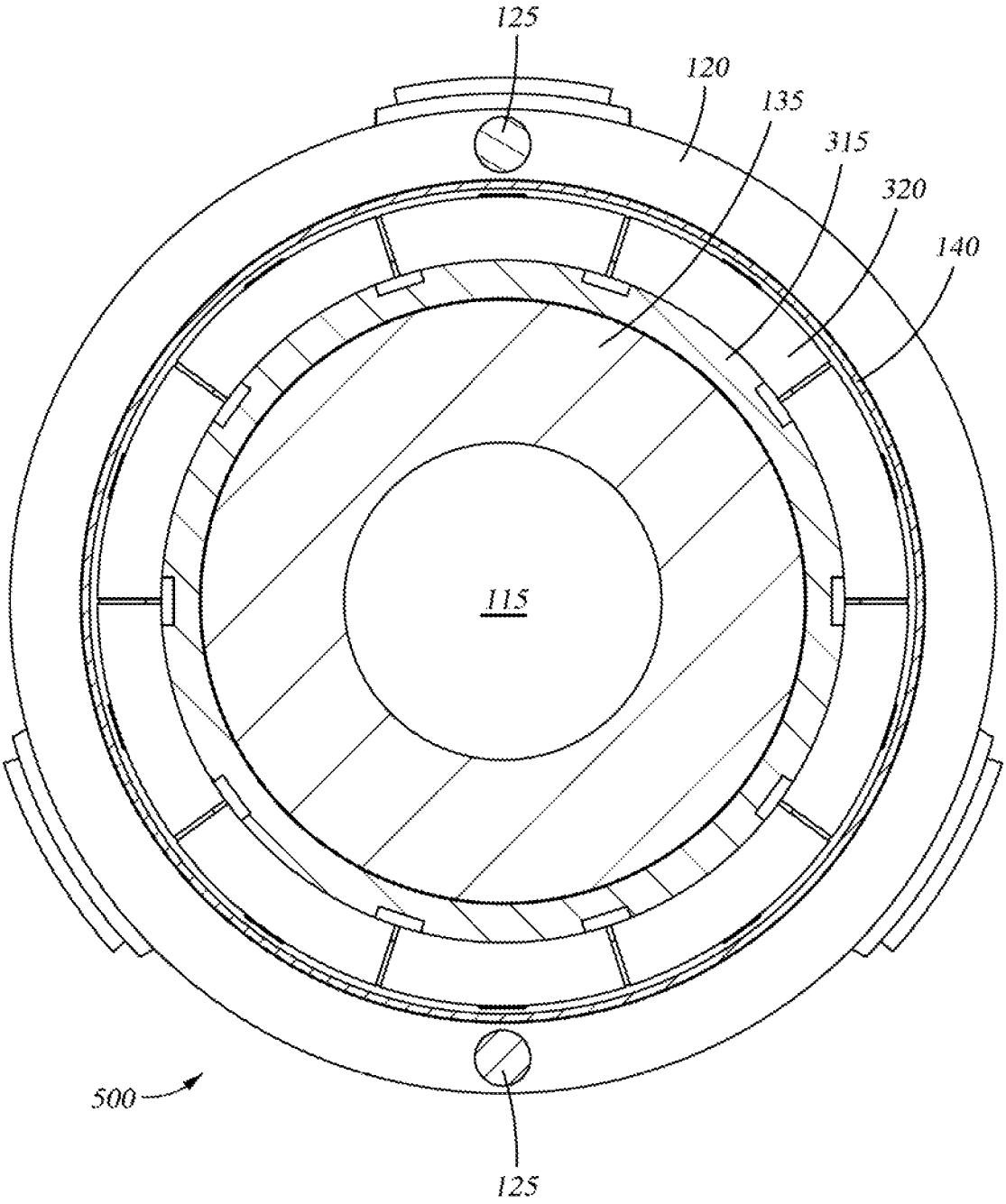

FIG. 4 is a front view of the assembled tool 500 showing the covers 120, 130 as well as the spacer pins 125 separating the covers. FIGS. 5 and 6 are section views of the deactivated tool 500 taken along lines 5-5 and 6-6 of FIG. 4. At the center of FIG. 5 is bore 115 formed in the inner tube 135 of the cover assembly 100. Surrounding the inner tube and axially movable relative to the inner tube is the carrier 315 and mounted on its outer surface are the magnets 320 attached to the carrier in radial groups 310 with the fasteners 325 also visible in the Figure. Surrounding the carrier 315 and magnet groups 310 is the particle shield 140 with a space provided between the two parts. As will be shown and explained herein, the particle shield 140 is a thin member that functions to prevent magnetically attracted debris from actually coming into contact with the magnets 320. Covering the particle shield is one of the covers 120 with a space between the two parts. FIG. 6 is a section view taken through another portion of the deactivated tool 500. The inner tube 135, carrier 315, and particle shield 140 are visible as well as two of the spacer pins 125. The magnets 320 and cover 120 are labeled but not directly visible in the section view of FIG. 6.

Figure 7:
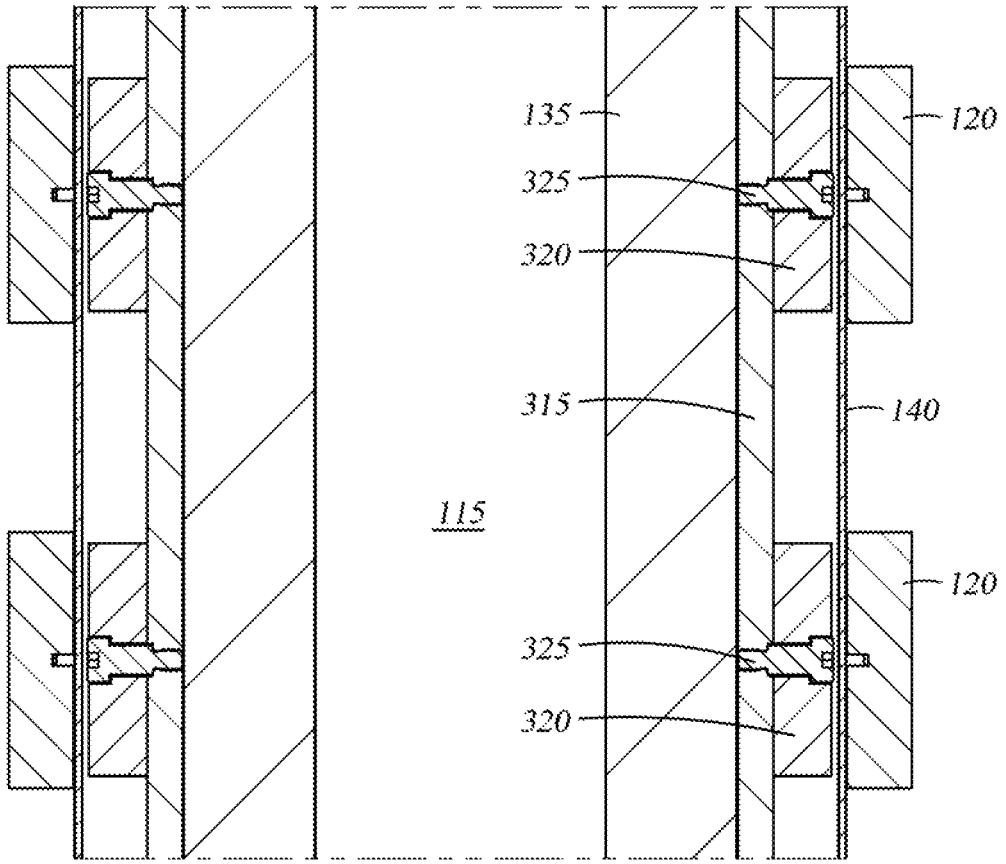
FIG. 7 is a section view showing the relationship between the covers and magnets of the tool in its deactivated position.

FIG. 7 is a section view showing the relationship between the covers 120 and magnets 320 of the tool 500 in its deactivated position. Visible is the inner tube 135, carrier 315, magnets 320, fasteners 325, covers 120 and particle shield 140. In the deactivated position, each magnet is underneath a cover preventing its magnetic properties from escaping to the wellbore (not shown) surrounding the tool 500. As will be illustrated and described herein, shifting the tool to the activated position includes moving the carrier with the attached magnets downwards in relation to the covers 120 in order to expose them to debris in the wellbore.

Figure 8:
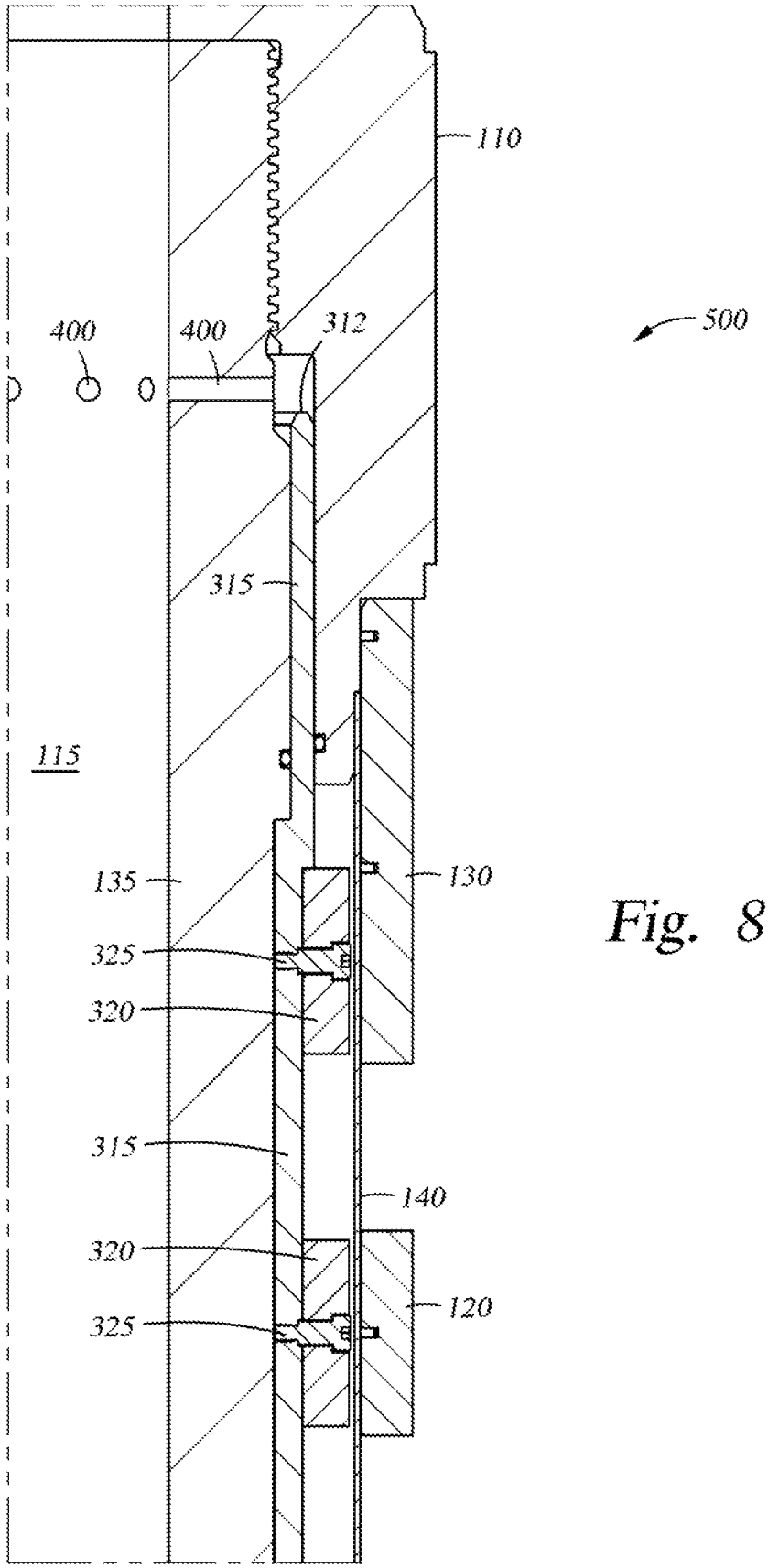
FIG. 8 is an enlarged section view showing an upper actuation portion of the tool.

FIG. 8 is an enlarged section view showing an upper actuation portion of the tool 500. As explained, an upper surface 312 of the carrier 315 operates as a piston surface causing the carrier to operate as an annular piston when a predetermined fluid pressure is placed on surface 312. Shown in the Figure is a port 400 creating a fluid path between the bore of the tool and surface 312. As the tool 500 moves to the activated position, the carrier and magnets will move down to a location wherein the magnets are no longer blocked by the covers 130, 120.

Figure 9:
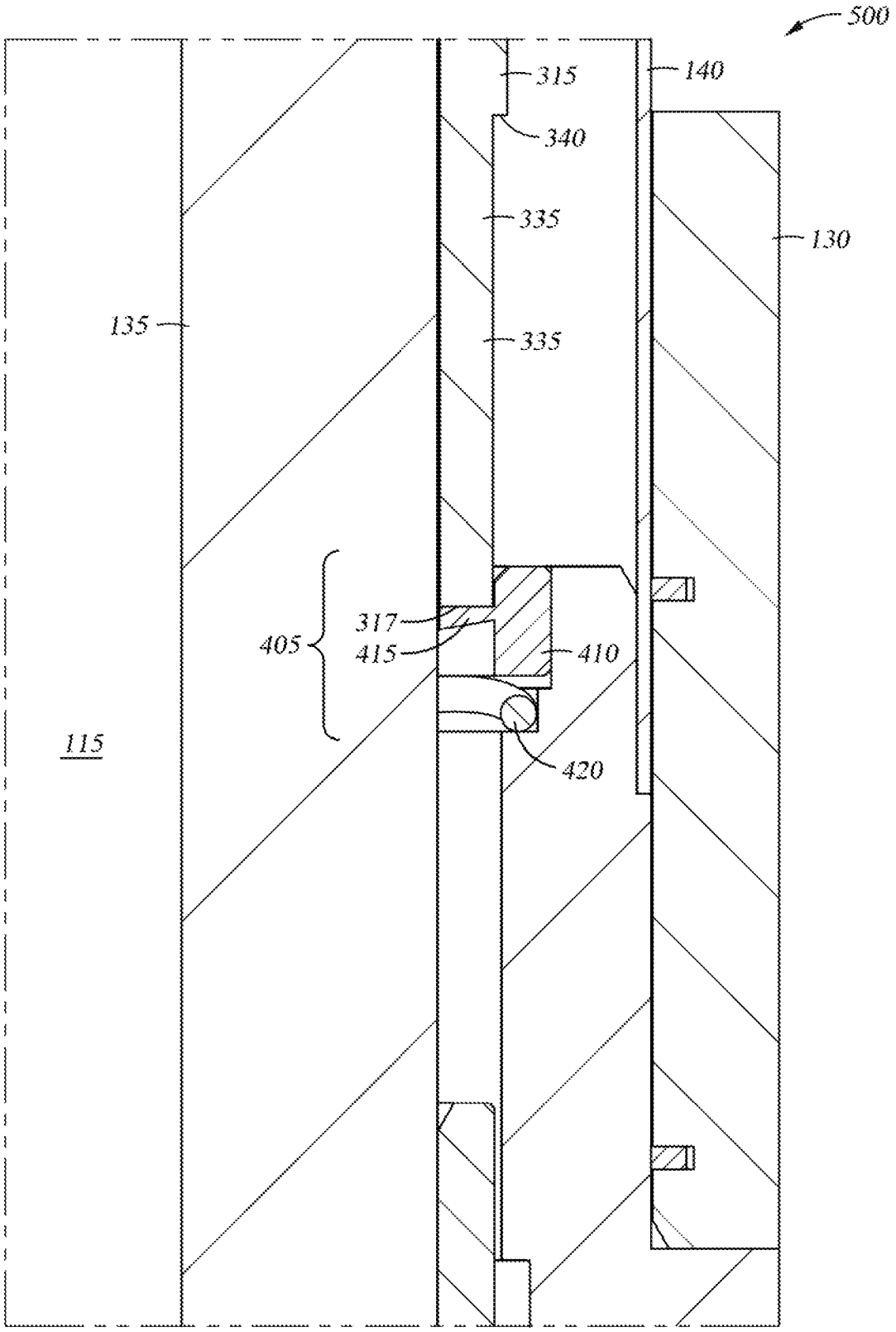
FIG. 9 is an enlarged section view showing a lower actuation portion of the tool.
Figure 10:
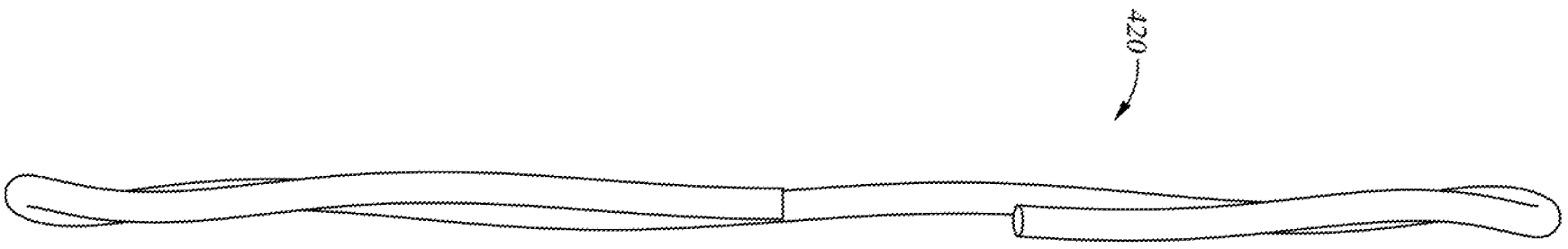
FIG. 10 is a front view of a wavy ring in its natural, wavy state.

FIG. 9 is an enlarged section view showing a lower actuation portion of the tool 500. Visible is a lower, reduced diameter portion 335 of carrier 315 having a lower face 317 constructed and arranged to act on a ring assembly 405 in order to initiate the transition of the tool 500 to the activated position. The ring assembly includes a first ring 410 having an inwardly extending shearable arm 415 that is acted upon by lower face 317 and a wavy ring 420 constructed and arranged to flatten and reform in order to compensate and absorb shock from unrelated pressure events in the wellbore that might otherwise actuate the tool 500 at an unwanted time. FIG. 10 is a front view of the wavy ring 420 in its natural, wavy state.

Figure 11:
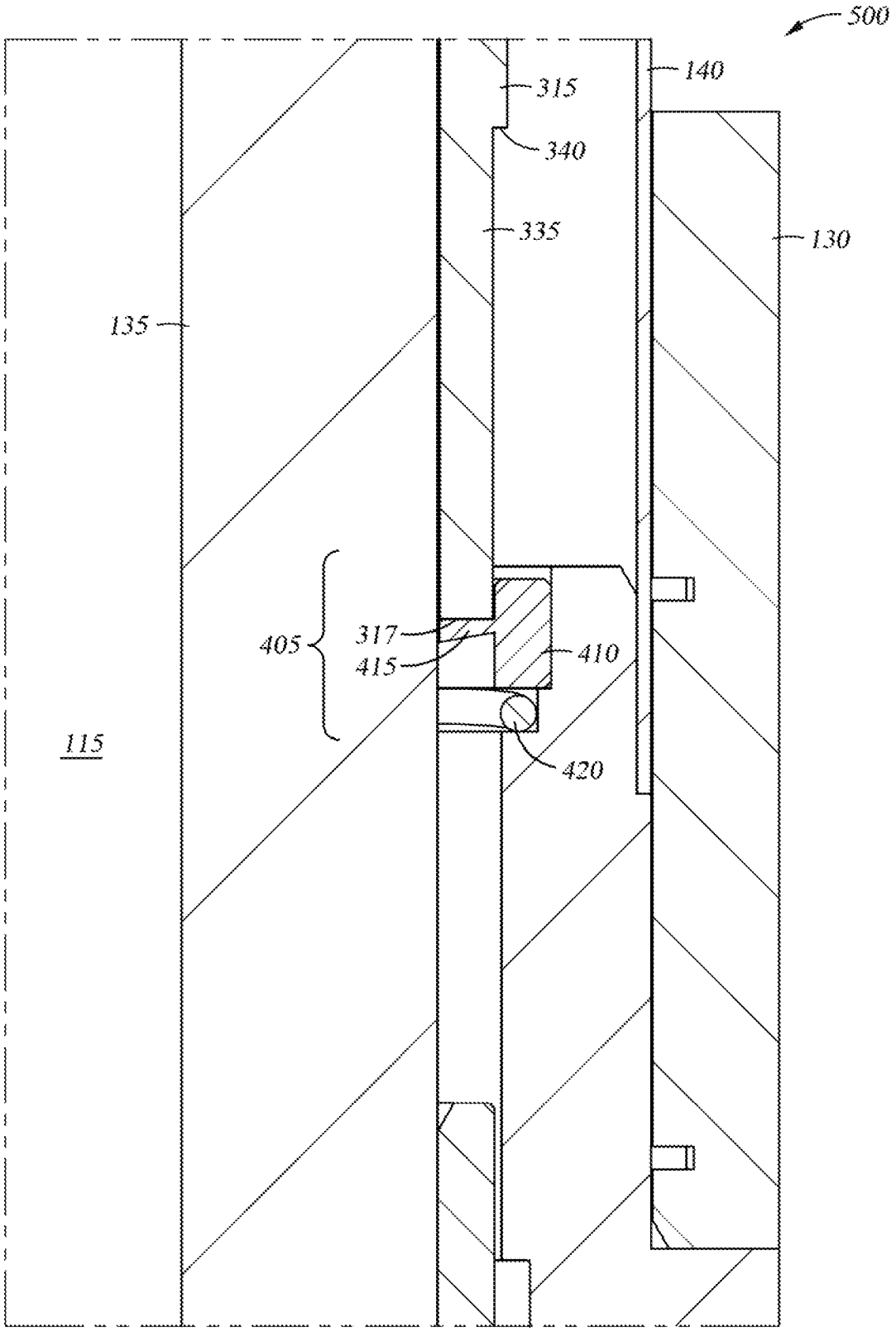
FIG. 11 is the enlarged section view of FIG. 9 with the wavy washer shown in a flattened state.
Figure 12:
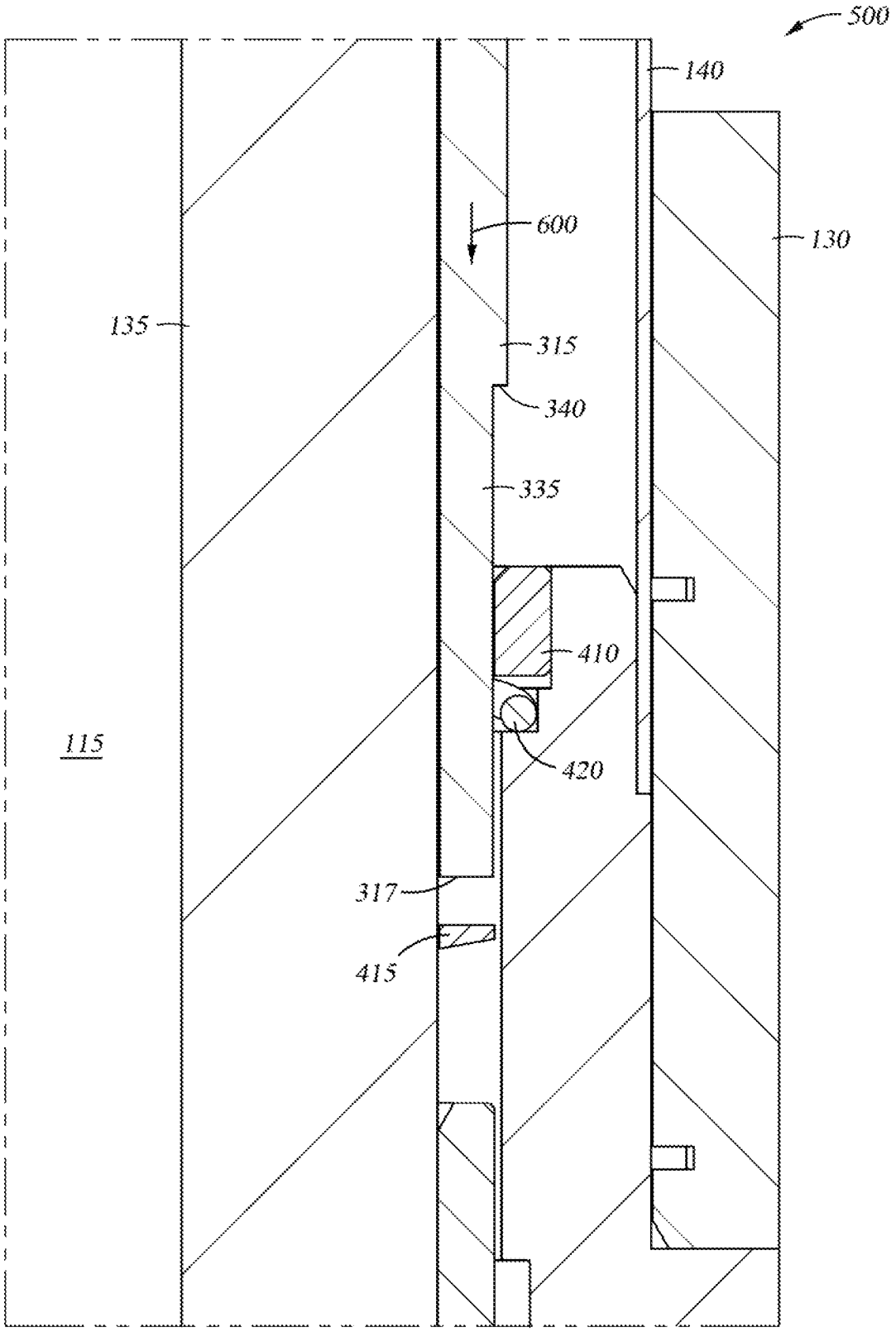
FIG. 12 is the enlarged section view of FIG. 11 showing the tool moving to an actuated position.

In the deactivated position shown in FIG. 9, face 317 is resting on shearable arm 415 and ring 420 retains its natural, wavy shape. FIG. 11 is an enlarged section view showing the same parts of the tool 500 as FIG. 9. In this view, the carrier 315 acting as an annular piston, has been acted upon at an upper end (not shown) by pressurized fluid and lower face 317 has applied enough pressure on the shearable arm 415 to cause it to flatten the wavy ring 420. In FIG. 12, an enlarged view of the same portions of the tool 500, fluid pressure applied to the carrier 315 has increased to the point where the shearable arm 415 of ring 410 has failed and the carrier 315 with its magnet groups 310 is moving downwards to its final, activated position. The downward movement is shown by arrow 600.

Figure 13:
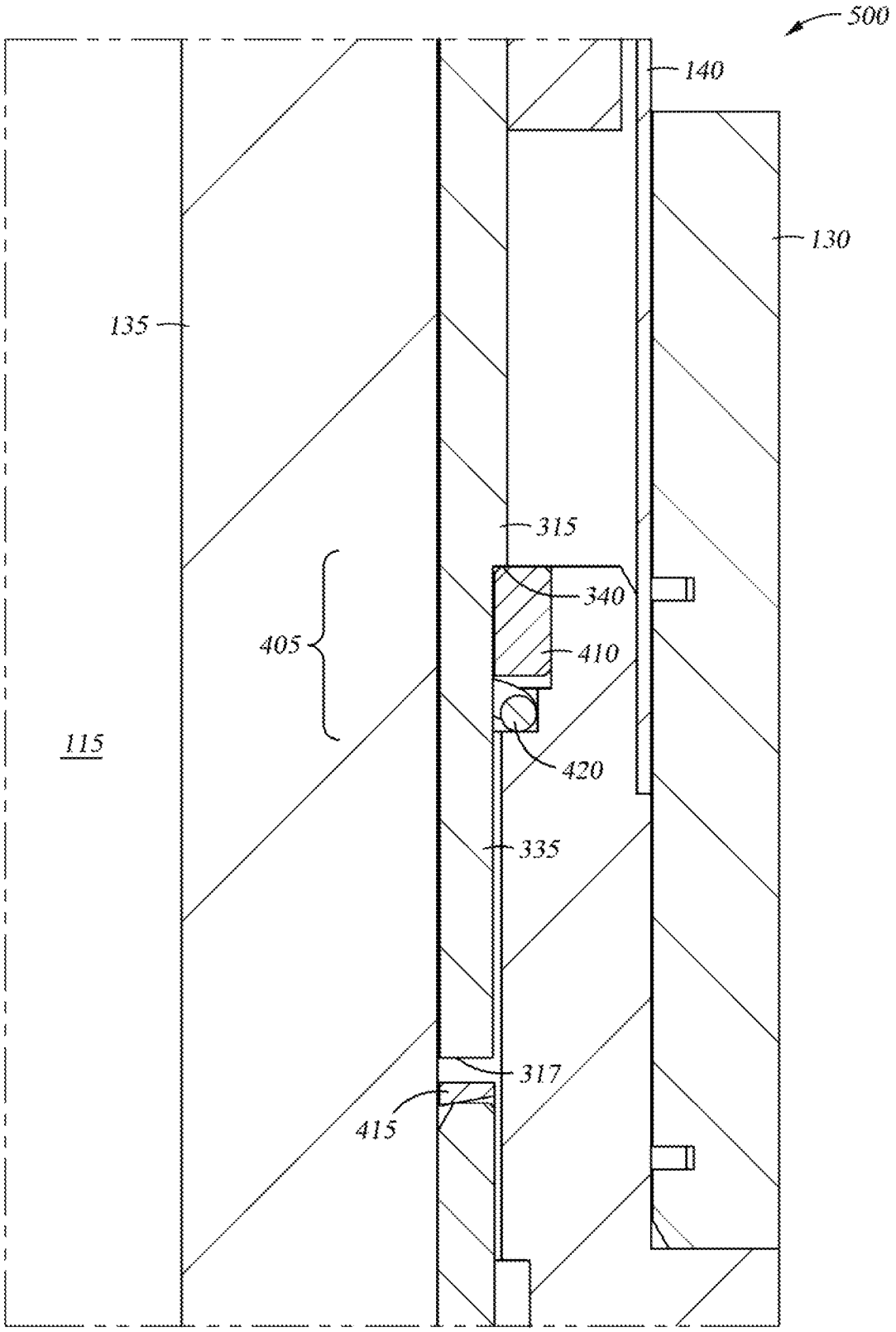
FIG. 13 is an enlarged section view of FIG. 12 showing the tool in its final activated position.

FIG. 13 is an enlarged section view showing the same portions of the tool 500 as the previous views, but showing the tool in its final activated position. In this position, the carrier has moved downwards relative to the other portions of the tool until shoulder 340 formed between the different diameters of the carrier has contacted an upper face of first ring 410 preventing additional downward movement.

Figure 14:
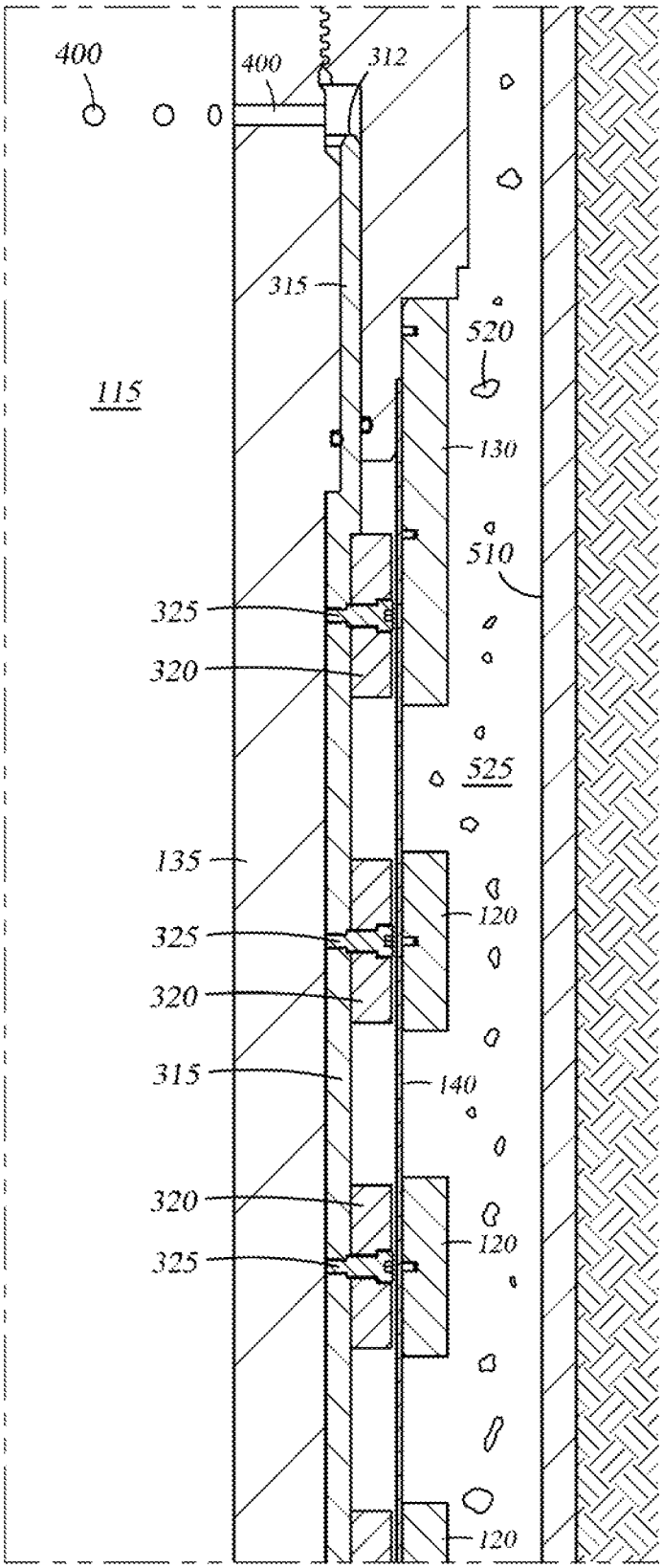
FIG. 14 is a section view showing an upper portion of the unactuated tool in a wellbore.
Figure 15:
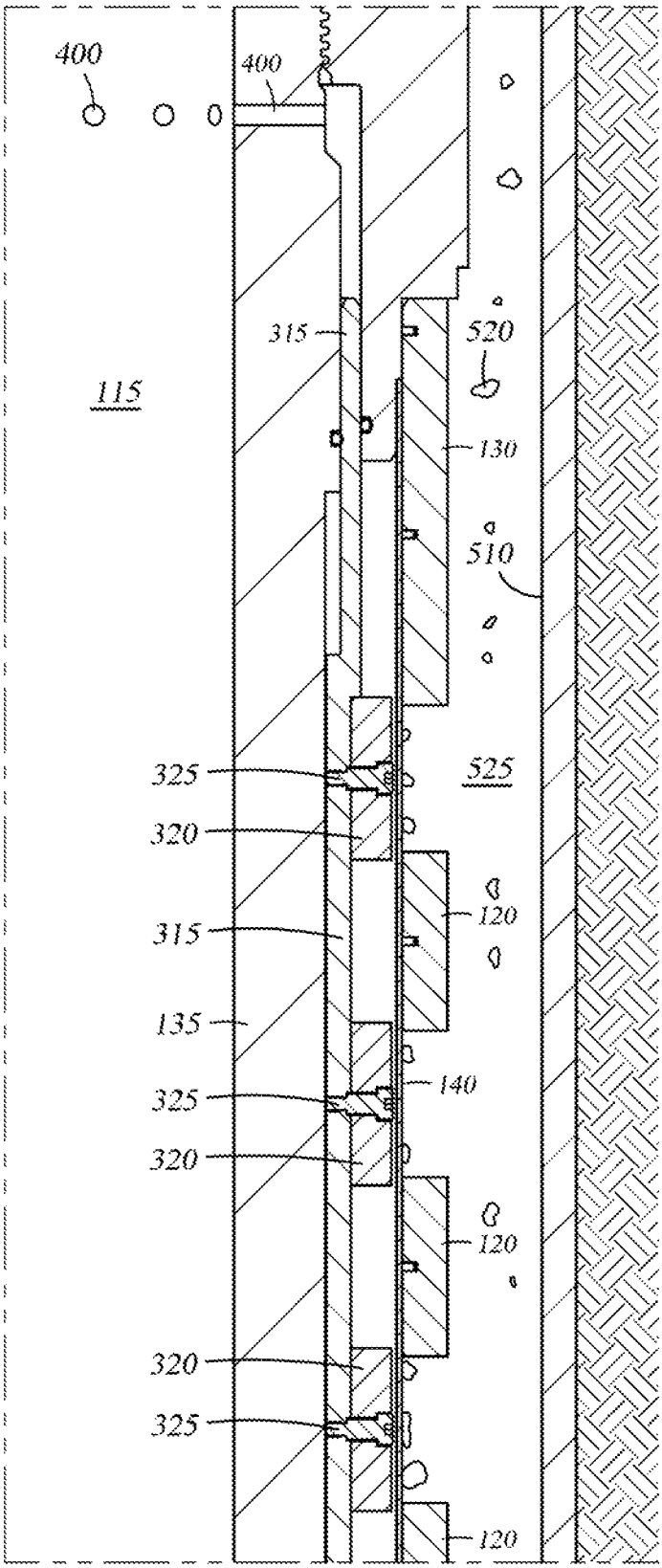
FIG. 15 is a section view showing an upper portion of the actuated tool in a wellbore.

FIG. 14 is a section view showing an upper portion of the unactuated tool 500 in a wellbore 510 with debris 520 visible in an annular area 525 between the tool and the wellbore walls. As shown, each magnet 320 of each magnet group 310 is blocked by a cover 120, 130. The unactuated position of the tool would be typical during run-in or in the case of multiple operations in the wellbore, at some point prior to a time when collection of debris is needed. For example, in a drilling operation, the tool 500 might remain in its unactuated position until drilling has taken place. In other instances, the tool will be run-in but only actuated after fluid has been circulated in the annulus 525 to stir up debris 520 and make it easier to attract magnetically. FIG. 15 is a section view of the same upper portion of the tool 500 shown in FIG. 14. However, in FIG. 15 the tool is fully actuated and the magnets 320 are "uncovered" with only the particle shield 140 between the magnets and the debris 520 that is being collected.

In one embodiment, the tool 500 includes a reset assembly 700 permitting the tool to be easily moved to the unactuated state once it has been recovered at the surface of a well. Shifting the tool back to its original position is useful for cleaning the various parts of the tool before it is returned to a facility to be readied for another use.

Figure 16:
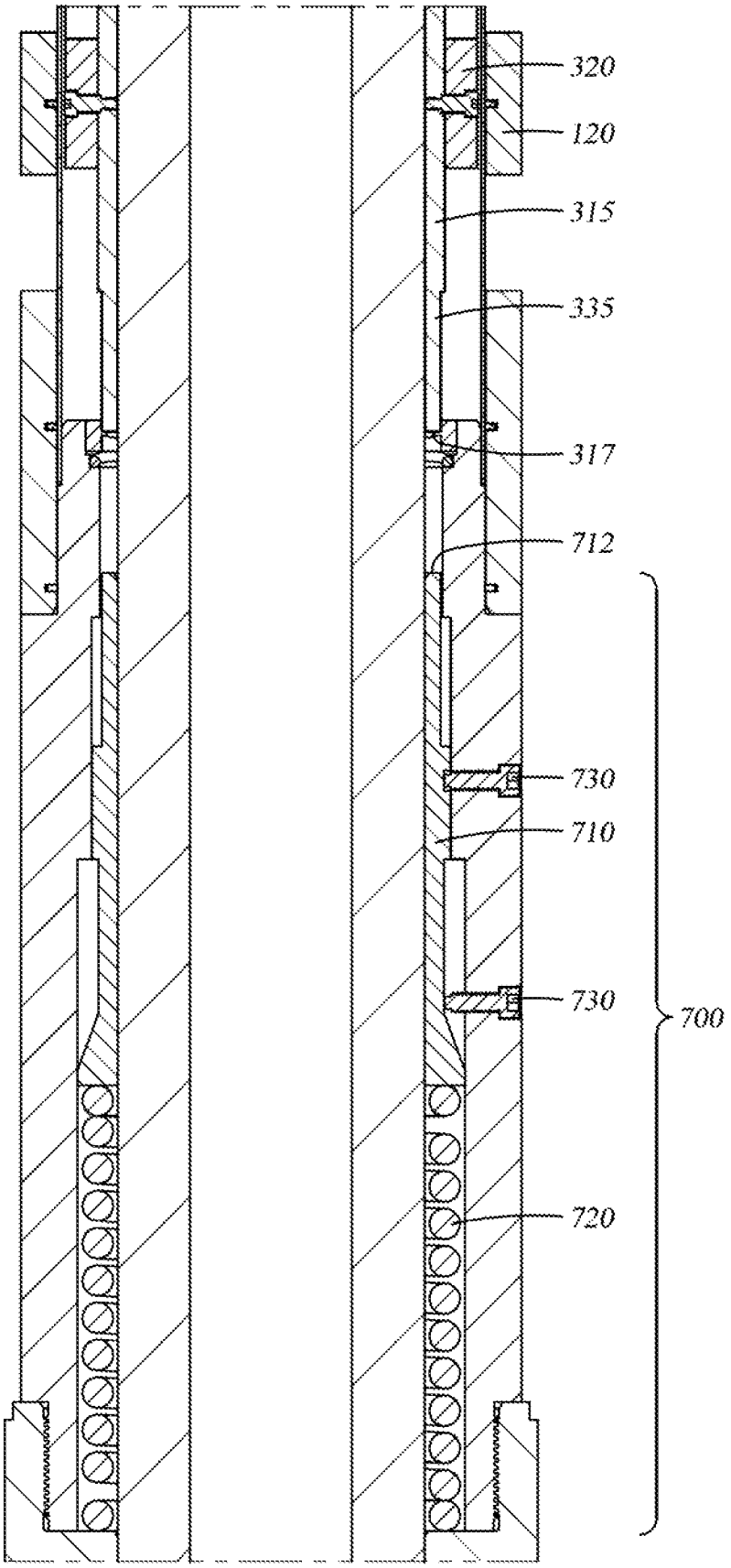
FIG. 16 is a section view of a reset assembly shown with the tool in the unactuated position.

FIG. 16 is a section view of a reset assembly shown with the tool in the unactuated position. The reset assembly 700 is constructed and arranged to apply pressure to the carrier 315 in order to return it to its original position relative to the cover assembly 100. The assembly 700 includes a spring-loaded reset piston 710 with a spring 720 initially held in a compressed position be two retainers 730. In the embodiment shown, the spring remains compressed throughout the downhole operation of the tool 500.

Figure 17:
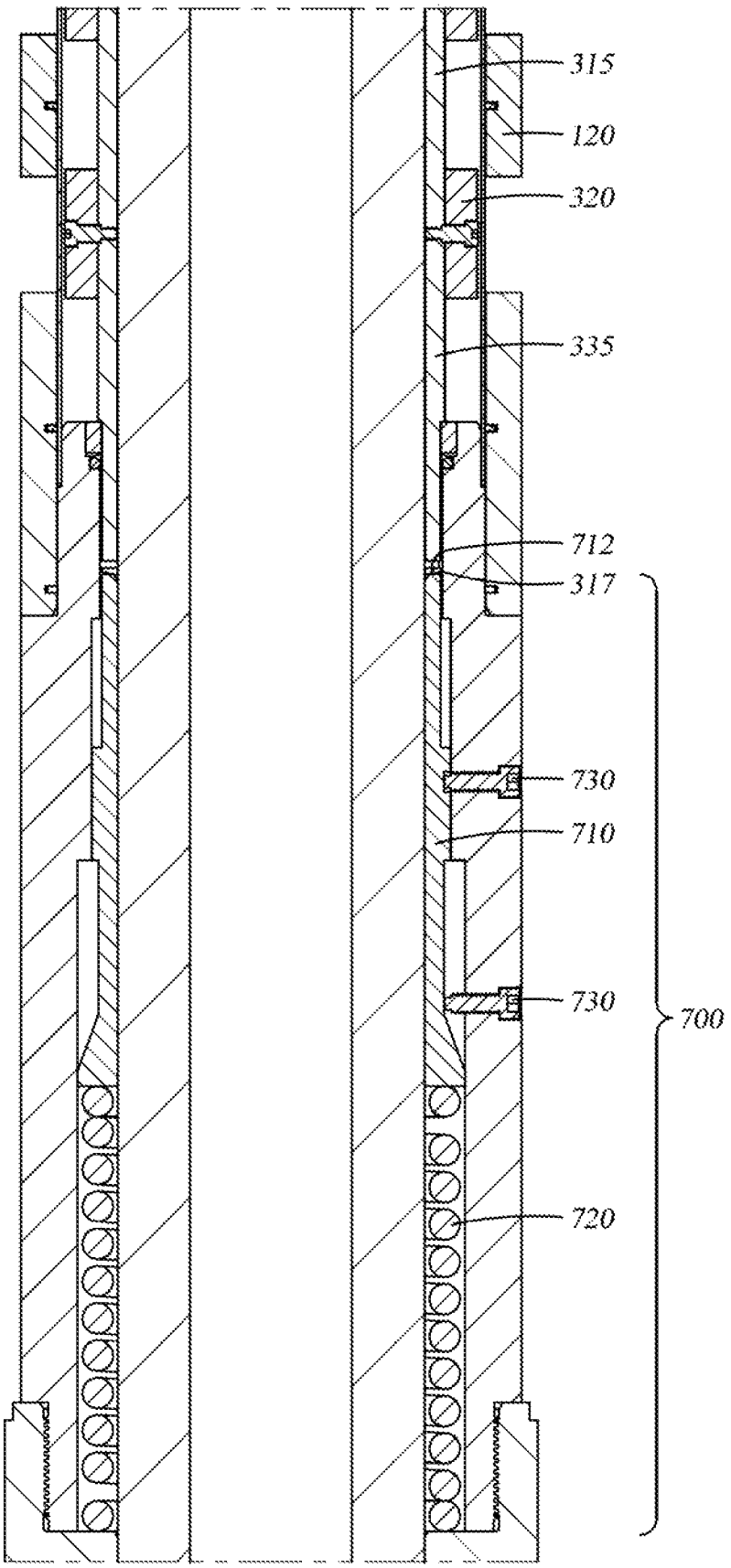
FIG. 17 is a section view of the reset assembly shown with the tool in the actuated position.

FIG. 17 is a section view of the reset assembly 700 shown with the tool in the actuated position. As shown, in the actuated position, the carrier 315 has moved downwards relative to the cover assembly 100 and the magnets 320 are exposed to the wellbore where they may attract debris (see FIG. 15). In this position the lower surface 317 of the reduced diameter portion 335 of the carrier 315 abuts an upper end 712 of the spring-loaded reset piston 710 which remains anchored in the charged/compressed position by the retainers 730.

Figure 18:
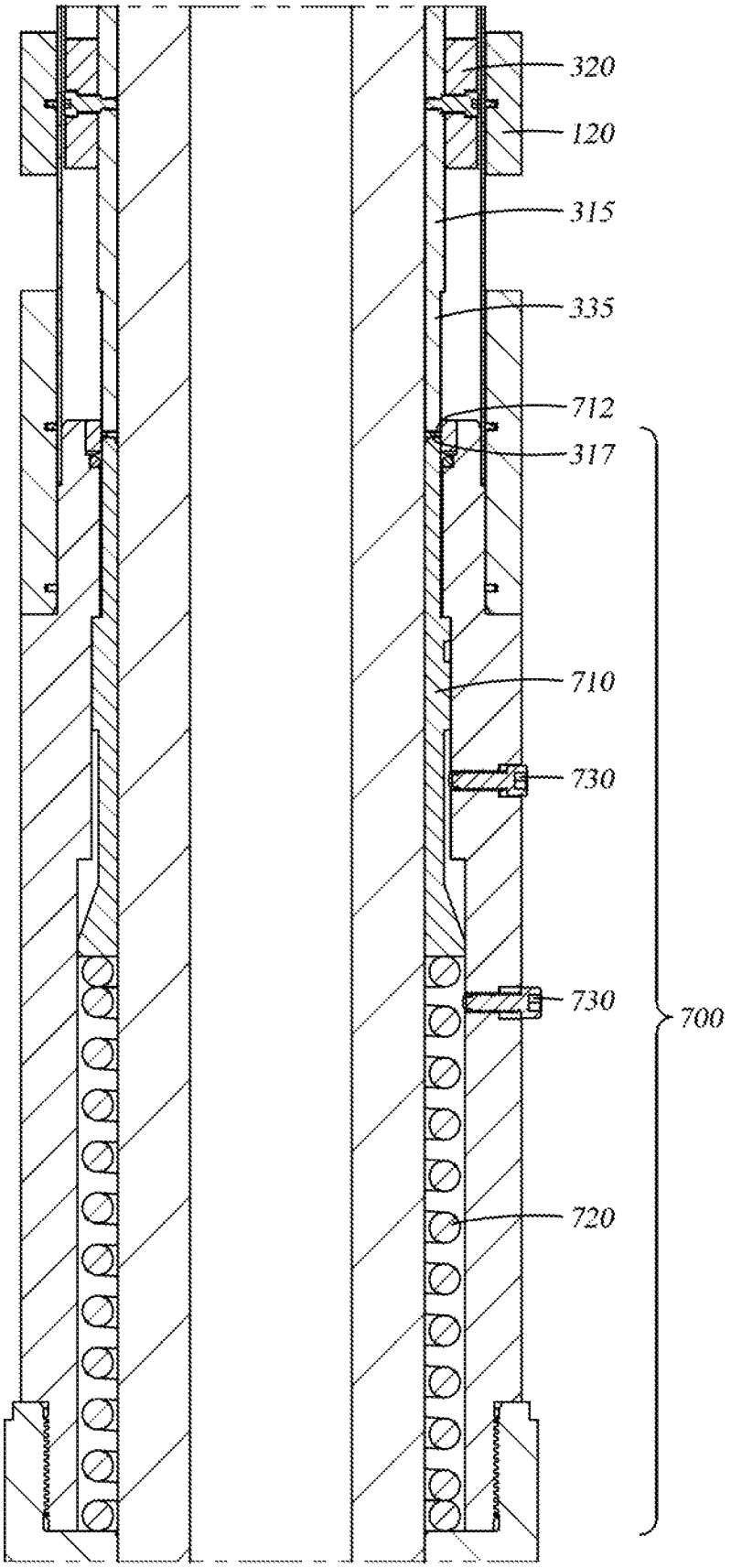
FIG. 18 is a section view of the reset assembly shown after the tool has been reset.

FIG. 18 is a section view of the reset assembly 700 shown after the tool 500 has been reset at the surface of the well. More specifically, retainers 730 have been loosened until they no longer interfere with the movement of the spring loaded reset piston 710 and the piston has moved upwards taking the magnet carrier 315 with it until the carrier is in the original, unactuated position with each magnet 320 blocked by a cover 120. In the position any collected debris can be removed prior to transporting the tool.

In operation, the tool 500 is run into a wellbore on a string of tubulars at such time as there is a need to collect iron-containing-type debris. The tool may be run-in alone or in combination with other tools like a drill bit. At any time there is a need for collection of debris, the tool can be actuated by providing a predetermined amount of fluid pressure, typically from the surface via port 400 to the upper surface 330 of the carrier 315. Typically, fluid is circulated in the annulus of the wellbore before or at the time the tool is shifted to its actuated position. Once a desired amount of debris is collected, usually determined by circulating over a set period of time, the tool can be removed, the debris discarded, and the tool re-set at the surface for another use.

While the foregoing is directed to embodiments of the present invention, other and further embodiments of the invention may be devised without departing from the basic scope thereof, and the scope thereof is determined by the claims that follow.

The invention claimed is:

1. A debris collection tool, comprising:

an inner mandrel;

a cover assembly disposed around the inner mandrel, the cover assembly including a plurality of covers spaced from one another along a length of the assembly creating a gap between adjacent covers; and a carrier disposed around the inner mandrel and within the cover assembly and axially movable relative to the inner mandrel and to the cover assembly, the carrier including an annular piston and a plurality of magnet groups spaced from one another along a length of the carrier whereby, in an unactuated position of the tool, each of the plurality of magnet groups is under one of the plurality of covers, and in an actuated position, each of the plurality of magnet groups is aligned with a gap between covers;

wherein the inner mandrel includes a port providing a fluid path between a bore of the tool and the annular piston of the carrier;

wherein the debris collection tool is configured to be actuated in a wellbore.

2. The tool of claim 1, wherein the carrier is movable within the cover assembly to shift the tool to the actuated position due to pressurized fluid being applied to the piston.

3. The tool of claim 1, wherein the plurality of covers are spaced from one another by spacer pins.

4. The tool of claim 3, wherein each of the plurality of magnet groups comprises a plurality of magnets radially disposed around an outer surface of the carrier and fixed thereto with a fastener.

5. The tool of claim 1, wherein the cover assembly includes a particle shield constructed and arranged to separate the magnet groups from debris being magnetically collected.

6. The tool of claim 5, further including a ring assembly disposed at a lower end of the carrier and constructed and arranged to absorb shock from pressure events acting upon the piston of the carrier.

7. The tool of claim 6, wherein the ring assembly includes a first ring including an inwardly extending shearable arm that is acted upon by a lower face of the carrier and a wavy ring below the first ring constructed and arranged to flatten and reform in response to the pressure events.

8. The tool of claim 7, wherein a predetermined fluid pressure on the annular piston causes the shearable arm to fail and the carrier to move axially downwards to the actuated position.

9. The tool of claim 1, further including a reset assembly for returning the tool to the unactuated position.

10. The tool of claim 9, wherein the reset assembly incudes a spring-loaded reset piston constructed and arranged to urge the carrier to the unactuated position at a predetermined time.

11. The tool of claim 10, wherein the reset assembly further includes at least one retainer for maintaining the spring-loaded reset piston in a compressed position until the predetermined time.

12. The tool of claim 1, wherein when the tool is in the unactuated position, each cover obscures the magnetic properties of a corresponding magnet of the plurality of magnet groups.

13. A method of operating a debris collection tool in a wellbore comprising:

running the tool into the wellbore on a string of tubulars to a predetermined depth, the tool including an inner mandrel and a carrier, the carrier disposed around the inner mandrel with spaced magnets mounted thereon and axially movable in a cover assembly, the cover assembly including a plurality of covers with a gap between adjacent covers; and providing fluid pressure through a port in the inner mandrel to a piston surface formed on the carrier thereby causing the tool to move from a deactivated position wherein the magnets are covered, to an activated position wherein the magnets are exposed to the wellbore.

14. The method of claim 13, wherein the piston surface is at an upper end of the carrier and the fluid pressure causes the carrier to move from a first position in the cover assembly to a second, lower position.

15. The method of claim 14, wherein moving the tool to the activated position requires causing a shearable arm on a ring to fail, the ring disposed in the cover assembly.

16. The method of claim 15, further including circulating fluid in the wellbore while the tool is in the activated position.

17. The method of claim 13 wherein moving the tool to the activated position is a second downhole operation taking place after a first operation, the first operation being a drilling operation.

18. A debris collection tool, comprising:

an inner mandrel;

a cover assembly disposed around the inner mandrel, the cover assembly including a plurality of covers spaced from one another along a length of the assembly such that a gap exists between adjacent covers;

a carrier disposed around the inner mandrel within the cover assembly and axially movable relative to the inner mandrel and to the cover assembly, the carrier including a plurality of magnet groups spaced from one another along a length of the carrier whereby, in an unactuated position of the tool, each of the plurality of magnet groups is under one of the plurality of covers, and in an actuated position, each of the plurality of magnet groups is aligned with a gap between covers; and a reset assembly configured to return the tool to the unactuated position;

wherein the debris collection tool is configured to be actuated in a wellbore.

19. The tool of claim 18, wherein the reset assembly incudes a spring-loaded reset piston constructed and arranged to urge the carrier to a position corresponding to the unactuated position of the tool at a predetermined time.

20. The tool of claim 19, wherein the reset assembly further includes at least one retainer for maintaining the spring-loaded reset piston in a compressed position until the predetermined time.

* * * * *